US008336259B2

(12) United States Patent
Ishida et al.

(10) Patent No.: US 8,336,259 B2
(45) Date of Patent: Dec. 25, 2012

(54) VEHICLE DOOR OPENING/CLOSING APPARATUS

(75) Inventors: Toshihiko Ishida, Niwa-gun (JP); Katsuhisa Yamada, West Bloomfield, MI (US); Yasuhiro Yamakawa, Toyohashi (JP); Tsuyoshi Kamiya, Anjo (JP); Shinji Kazama, Kariya (JP)

(73) Assignee: Aisin Seiki Kabushiki Kaisha, Kariya-shi, Aichi-ken (JP)

( * ) Notice: Subject to any disclaimer, the term of this patent is extended or adjusted under 35 U.S.C. 154(b) by 299 days.

(21) Appl. No.: 12/679,261

(22) PCT Filed: Feb. 26, 2009

(86) PCT No.: PCT/JP2009/053562

§ 371 (c)(1),
(2), (4) Date: Mar. 19, 2010

(87) PCT Pub. No.: WO2009/107722

PCT Pub. Date: Sep. 3, 2009

(65) Prior Publication Data

US 2010/0251619 A1 Oct. 7, 2010

(30) Foreign Application Priority Data

Feb. 28, 2008 (JP) ..... 2008-048547

(51) Int. Cl.
*E05F 11/00* (2006.01)

(52) U.S. Cl. ..... 49/358; 49/360

(58) Field of Classification Search ..... 49/248, 49/249, 352, 358, 360; 155/155
See application file for complete search history.

(56) References Cited

U.S. PATENT DOCUMENTS 3,530,619 A 9/1970 Parrella et al.
5,548,930 A 8/1996 Morando
5,890,321 A * 4/1999 Staser et al. ..... 49/502
6,305,129 B1 * 10/2001 Eckhardt et al. ..... 49/502
(Continued)

FOREIGN PATENT DOCUMENTS

JP 52-35018 A 3/1977
(Continued)

OTHER PUBLICATIONS

English Translation of the International Preliminary Report on Patentability (IPRP) (Forms PCT/IB/338 and PCT/IB/373) and English Translation of the Written Opinion of the International Searching Authority (Form PCT/ISA/237) issued by the World Intellectual Property Organization in corresponding International Application No. PCT/JP2009/053562 dated Nov. 1, 2010.
(Continued)

*Primary Examiner* — Jerry Redman
(74) *Attorney, Agent, or Firm* — Buchanan Ingersoll & Rooney

(57) ABSTRACT

A vehicle door opening/closing apparatus includes a drum unit disposed on the side of one face of an inner panel constituting a vehicle door and including a take-up drum capable of taking up a length of cable disposed between the vehicle and the vehicle door, a drive unit disposed on the side of the other face of the inner panel and configured to drive the take-up drum, a power transmission mechanism configured for transmitting a rotational drive force of the drive unit to the take-up drum, with allowing engagement and disengagement between take-up drum and the drive unit, and a coupling mechanism for coupling the drive unit to the drum unit, with the inner panel being clamped there between.

20 Claims, 9 Drawing Sheets

U.S. PATENT DOCUMENTS

| | | | | |
|---|---|---|---|---|
| 6,427,386 | B1 | 8/2002 | Kalb et al. | |
| 6,530,619 | B2 | 3/2003 | Fukumoto et al. | |
| 6,574,922 | B2 * | 6/2003 | Velthaus et al. | 49/352 |
| 6,634,142 | B2 * | 10/2003 | Dobson et al. | 49/352 |
| 7,350,334 | B2 * | 4/2008 | Smith | 49/352 |
| 7,354,370 | B2 * | 4/2008 | Sesselmann | 475/149 |
| 7,856,759 | B2 * | 12/2010 | Elliott et al. | 49/358 |
| 8,096,606 | B2 * | 1/2012 | Hanaki et al. | 296/155 |
| 8,141,297 | B2 * | 3/2012 | Elliott et al. | 49/358 |
| 2002/0043818 | A1 | 4/2002 | Fukumoto et al. | |
| 2005/0016071 | A1 * | 1/2005 | Takeda et al. | 49/352 |
| 2005/0046230 | A1 * | 3/2005 | Fukumoto et al. | 296/155 |
| 2006/0112643 | A1 | 6/2006 | Yokomori et al. | |
| 2007/0163179 | A1 * | 7/2007 | Fukumura et al. | 49/360 |
| 2007/0209283 | A1 * | 9/2007 | Ostrowski et al. | 49/360 |

FOREIGN PATENT DOCUMENTS

| | | | |
|---|---|---|---|
| JP | 6-511450 | A | 12/1994 |
| JP | 2001-199236 | A | 7/2001 |
| JP | 2001-513726 | A | 9/2001 |
| JP | 2001-336352 | A | 12/2001 |
| JP | 2003-074253 | A | 3/2003 |
| JP | 2004-142681 | A | 5/2004 |
| JP | 2005-273162 | A | 10/2005 |
| JP | 2007-217865 | A | 8/2007 |
| WO | WO 2007/017278 | A1 | 2/2007 |

OTHER PUBLICATIONS

Office Action dated Dec. 22, 2011, issued in the corresponding Japanese Patent Application No. 2010-500738, and an partial English Translation thereof.

International Search Report issued by the Japanese Patent Office on Jun. 9, 2009 as the International Searching Authority in International Application No. PCT/JP2009/053562.

Written Opinion issued by the Japanese Patent Office on Jun. 9, 2009 as the International Searching Authority in International Application No. PCT/JP2009/053562.

Office Action dated Sep. 27, 2012, issued in corresponding Japanese Patent Application No. 2010-500738.

Concise explanation of relevance of JP 2007-217865.

* cited by examiner

Fig.10
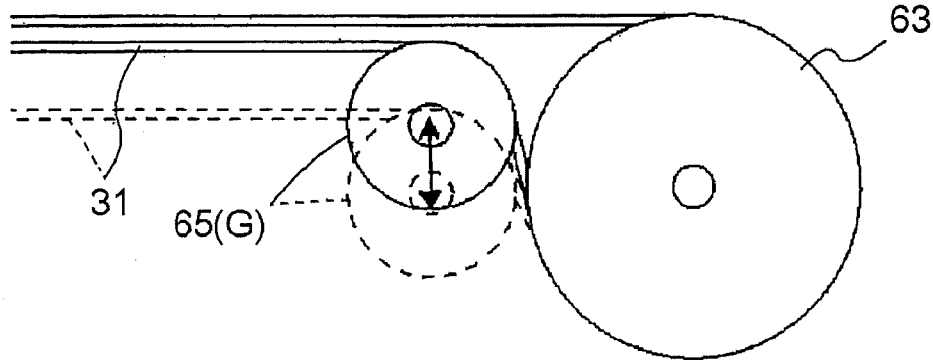
【Fig.11】
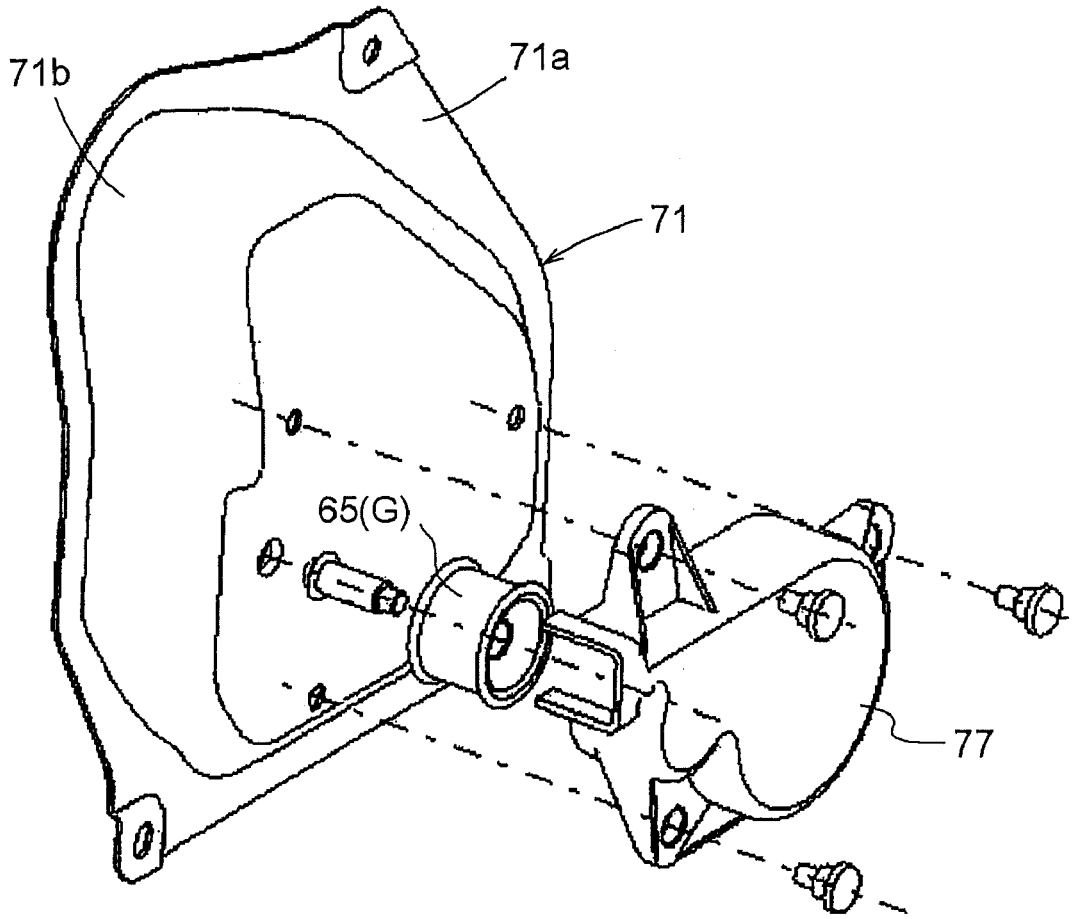

VEHICLE DOOR OPENING/CLOSING APPARATUS

TECHNICAL FIELD

The present invention relates to a vehicle door opening/closing apparatus provided at a lateral portion of a vehicle.

BACKGROUND ART

As an example of such vehicle door opening/closing apparatus as above, there is known an apparatus including a take-up drum capable of taking up a length of cable disposed between the vehicle and a sliding door of the vehicle and a drive mechanism for driving the take-up drum. In operation, as the take-up drum driven by the drive mechanism takes up a length of the cable, the sliding door provided at a lateral portion of the vehicle is controllably opened/dosed. As for the disposing positions of the take-up drum and the drive mechanism, both a type in which these are disposed on the outer side of the vehicle and a further type in which they are disposed inside the sliding door are known. As an example of the latter type of disposing them inside the sliding door, there is known a vehicle door opening/closing apparatus as disclosed in Patent Document 1 identified below.

In the vehicle door opening/closing apparatus disclosed in Patent Document 1, the take-up drum and the drive mechanism are disposed inside the sliding door, with the drum and the mechanism being integrated as a unit. These are disposed at a lower portion inside the sliding door which is formed relatively spacious, and the cable extended from the take-up drum is guided to the vehicle side via a relay mechanism disposed inside the sliding door.

Patent Document 1: Japanese Patent Application "Kokai" No. 2003-74253

DISCLOSURE OF INVENTION

However, with the vehicle door opening/closing apparatus disclosed in Patent Document 1, since the take-up drum and the drive mechanism are to be mounted as an integral unit to the inner panel inside the sliding door from the time of its assembly, the assembly worker needs to handle this unit which has a large weight as including a motor, etc. So, the workload for the worker was significant.

Further, the sliding door consists of an outer door (see mark O in FIG. 2) which is comprised of an outer panel (see numeral 3 in FIG. 2) formed of a pressed component and an inner panel (see numeral 5 in FIG. 2) and an inner door (see mark I in FIG. 2) which is comprised of an inner panel and an interior member (see numeral 4 in FIG. 2) disposed on the vehicle cabin side thereof. In this, the space between the outer panel 3 and the inner panel 5 (the inside of the outer door) is an area which is located inside the door, but is subjected to possible penetration of water from the outside of the vehicle. On the other hand, the inside of the inner door is an area which is shielded against such penetration of water from the outside of the vehicle. The drive mechanism includes such electric/electronic components as the motor, an ECU, etc. Therefore, if this drive unit is to be disposed inside the sliding door as a unit integrated with the take-up drum, it is desired that the unit be disposed between the inner panel 5 having high water-proofness and the interior member 4. However, the cable extended via the relay mechanism is arranged from between the outer panel 3 and the inner pane 5 to the vehicle body side. So, if the take-up drum and the drive are disposed as an integral unit inside the sliding door, there arises a need to extend this cable once through the inner panel 5 from the interior member 4 side to the outer panel 3 side, so the arraying operation of the cable is troublesome. On the other hand, in case this integral unit is disposed between the outer panel 3 and the inner panel 5, such problem does not arise. However, since the space between the outer panel 3 and the inner panel 5 is an area that water can enter from the outside of the vehicle as described above, there arises a need for separately providing the drive mechanism with water-proofness. Hence, the production cost will increase disadvantageously.

The present invention has been made in view of the above-described situation. The primary object of the present invention is to provide a vehicle door opening/closing apparatus that can reduce the workload for the worker at the time of its assembly to the vehicle and that also allows the drive mechanism to be disposed in a water-proof environment at low costs and in a reliable manner.

For accomplishing the above-noted object, according to a characterizing feature of the present invention, a vehicle door opening/closing apparatus comprises:

a drum unit disposed on the side of one face of an inner panel constituting a vehicle door and including a take-up drum capable of taking up a length of cable disposed between the vehicle and the vehicle door;

a drive unit disposed on the side of the other face of the inner panel and configured to drive the take-up drum;

a power transmission mechanism configured for transmitting a rotational drive force of the drive unit to the take-up drum, with allowing engagement and disengagement between take-up drum and the drive unit; and a coupling mechanism for coupling the drive unit to the drum unit, with the inner panel being clamped therebetween.

With the above-described characterizing feature, since the power transmission mechanism configured for transmitting a rotational drive force of the drive unit to the take-up drum allows engagement and disengagement between take-up drum and the drive unit, the drum unit having the take-up drum and the drive unit can be formed as separate units. Therefore, these drive unit and drum unit can be disposed separately on the opposed sides of the inner panel constituting the vehicle door, such that the drive unit can be disposed between the inner panel which is an area having high water-proofness and the interior member, while the drum unit can be disposed between the outer panel and the inner panel from which the cable is to be arranged toward the vehicle body side. As a result, the drive unit and the drum unit can be appropriately disposed in the two areas inside the sliding door and sectioned from each other by the inner panel therebetween, respectively. Therefore, there is no need for providing any special water-proof treatment to the drive mechanism and there is no need to extend the cable through the inner panel, either.

Further, as the drum unit and the drive unit are provided as separate units, it is possible to assemble these units separately one after another, and as the weights are divided, the workload for the worker at the time of the assembly to the vehicle can be alleviated.

Consequently, it has become possible to provide a vehicle door opening/closing apparatus that can reduce the workload for a worker at the time of its assembly to the vehicle and that also allows the drive mechanism to be disposed in a water-proof environment, at low costs and in a reliable manner.

Preferably, the drum unit is disposed between an outer panel constituting the vehicle door and the inner panel and the drive unit is disposed between an interior member constituting the vehicle door and the inner panel.

With this construction, it becomes possible to dispose the drive unit in the area having high water-proofness and to dispose the drum unit in the area from which the cable is to be arranged toward the vehicle body side, respectively in a reliable manner.

Preferably, the drum unit includes a guide member configured to change the direction of the cable extended from the take-up drum, and the take-up drum and the guide member are fixed to a base plate disposed in opposition to the inner panel.

With this construction, since the drum unit includes a guide member configured to change the direction of the cable extended from the take-up drum, the cable can be arranged in an appropriate manner between the vehicle body side and the take-up drum. Further, since the take-up drum and the guide member are fixed to a base plate disposed in opposition to the inner panel and the drive unit and the drum unit are coupled to each other so as to clamp this base plate and the inner panel therebetween, the base plate and the inner panel together reinforce the respective rigidity thereof each other. Therefore, when the take-up drum is rotatably driven to take up the cable, even if a large tension is applied to the length of the cable between the take-up drum and the guide member, it is possible to prevent warping of the base plate or even destruction of the drive unit per se in some case.

Preferably, the inner panel includes a through hole extending through the one face and the other face thereof, and a base plate on which one face side the drum unit is disposed and on which other face side the drive unit is disposed in the through hole.

With this construction, the drive unit and the drum unit can be coupled to the base plate, thereby to form an integral unit in advance and then this unit can be assembled to the inner panel in such a manner as to close the through hole. In this way, the base plate can be a member constituting the inner panel and also the drive unit and the drum unit can be easily assembled to the inner panel.

Further, as the drive unit and the drum unit are coupled so as to clamp the base plate therebetween, the base plate and the inner panel together reinforce the respective rigidity thereof each other.

Preferably, the drum unit includes a guide member configured to change the direction of the cable extended from the take-up drum, and the take-up drum and the guide member are fixed to the base plate.

With this construction, since the drum unit includes a guide member configured to change the direction of the cable extended from the take-up drum, the cable can be arranged in an appropriate manner between the vehicle body side and the take-up drum.

Preferably, the guide member can be changed in its attaching position relative to the base plate.

With this construction, when e.g. the guide member is to be assembled to the base plate, there can be provided a greater degree of freedom in setting the inter-path pitch of the cable. To this end, an arrangement can be provided such that the fixing can be effected with disposing the guide member at the optimal position by sliding this guide member for instance.

Preferably, the guide member comprises a pulley attached to the base plate.

With use of a pulley, it is possible to reduce friction between the guide member and the cable in the course of changing of the direction of the cable. Further, by setting a rotational shaft of the pulley to a predetermined angle, the arranging direction of the cable relative to the drum unit can be determined as desired.

Preferably, the guide member comprises a guide groove provided in the drum unit.

With this construction, the direction of the cable can be changed simply by laying the length of the cable along the guide groove. So, the guide member can be formed easily.

Further, the pulley can include a sliding contact face for a support member for rotatably supporting this pulley to the base plate, and this sliding contact face has a shape curved along an axial direction of the support member.

With the above construction, e.g. even if the support member has been mounted with some inclination, the posture of the pulley can be maintained appropriate, thanks to the curved shape of the sliding contact face.

BRIEF DESCRIPTION OF THE DRAWINGS

FIG. 10 is an enlarged view showing the guide member mounted to the base plate in the further embodiment, FIG. 11 is an exploded perspective view showing the guide member mounted to the base plate in the further embodiment.

BEST MODE OF EMBODYING THE INVENTION

Next, embodiments of the present invention will be described with reference to the accompanying drawings.

Figure 1:
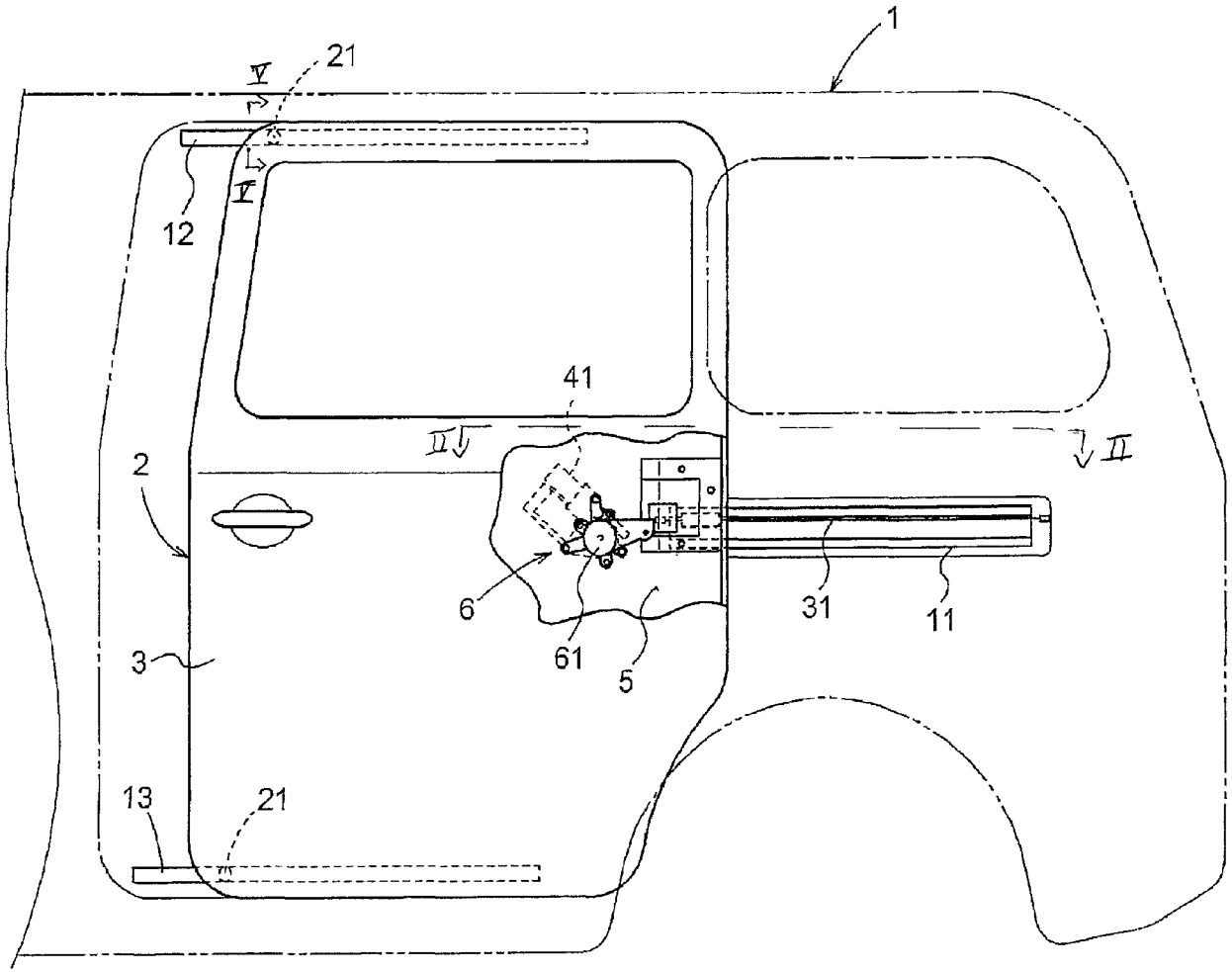
FIG. 1 is a side view of a vehicle having a vehicle door opening/closing apparatus relating to the present invention.

FIG. 1 is a side view of a vehicle 1 including a vehicle door opening/closing apparatus 6 relating to the present invention. As this vehicle 1 includes the vehicle door opening/closing apparatus 6, opening and closing operations of a sliding door 2 can be effected automatically.

The sliding door 2 is slidably supported along a center guide rail 11 and an upper and lower pair of an upper guide rail 12 and lower guide rail 13 that extend along the front/back direction (right/left direction in FIG. 1) of the vehicle 1.

The upper guide rail 12 is disposed along the upper edge of a door opening and in the vicinity of this upper edge and is fixed to a lateral portion of the vehicle 1. The lower guide rail 13 is disposed along and in the vicinity of the lower edge of the door opening and is fixed to a lateral portion of the vehicle 1. Further, the center guide rail 11 is fixed to a outer side of the vehicle cabin on the vehicle body side at a height substantially midway between the upper guide rail 12 and the lower guide rail 13.

The sliding door 2 pivotally supports guide roller units 21 which are slidably guided by the guide rails 11, 12, 13, respectively. In operation of the sliding door 2, as the respective guide roller units 21 are caused to slide relative to the guide rails 11, 12, 13 corresponding thereto, the sliding door 2 is slid as being guided by the guide rails 11, 12, 13. Incidentally, the guide rails 11, 12, 13 are substantially parallel with each other and the front ends thereof are curved toward the vehicle cabin inner side so that the sliding door 2 may be disposed substantially flush with the vehicle cabin outer face on the lateral side of the vehicle 1 when the door is closed (see FIG. 2). Further, when the door opening is opened, the sliding door 2 is disposed on the vehicle cabin outer face, at more rearward lateral portion of the vehicle 1 than the door opening.

Figure 5:
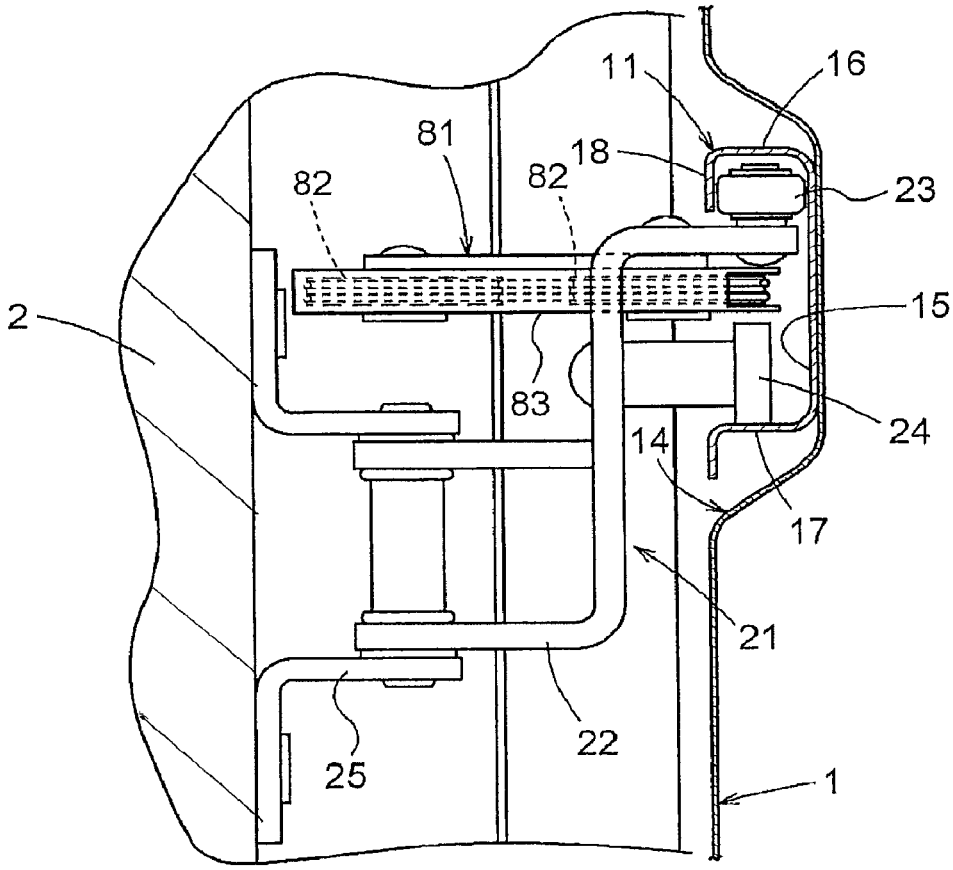
FIG. 5 is a vertical section view showing the periphery of a guide roller unit.

As shown in FIG. 5, the center guide rail 11 is disposed within a concave portion 14 formed in the vehicle cabin outer face at the lateral portion of the vehicle 1. This center guide rail 11 includes a vertical wall 15 connected to the vehicle cabin outer face of the main body of the vehicle 1, an upper wall 16 and a lower wall 17 that extend parallel with each other from the upper end and the lower end of the vertical wall 15 and extend with a curve toward the vehicle cabin outer side of the vehicle 1, and a flange wall 18 extending and bent downward from the vehicle cabin outer end of the upper wall 16 in parallel with the vertical wall 15, thus the rail 11 as a whole having a substantially angular hooked cross sectional shape.

The guider roller unit 21 includes a base bracket 22, an inner/outer roller 23 and an upper/lower roller 24. The base bracket 22 is supported to be rotatable relative to a bracket 25 which is fixed to the sliding door 2, whereby the guide roller unit 21 is pivotally supported to the sliding door 2. Further, to the base bracket 22, there is rotatably supported the inner/outer roller 23 which comes into sliding contact with the flange wall 18 and the vertical wall 15 of the center guide rail 11. Also, to the base bracket 22, there is rotatably supported the upper/lower roller 24 which comes into sliding contact with the lower wall 17 of the center guide rail 11. With these, the guide roller unit 21 is slidably guided by the center guide rail 11, without looseness relative thereto.

Incidentally, the guide roller units 21 slidably guided by the upper guide rail 12 and the lower guide rail 13 have similar constructions as above. With these, the sliding door 2 is slidably supported to the lateral portion of the vehicle 1, by the guide roller units 21 via the guide rails 11, 12, 13. So that, sliding operations of the sliding door 2 are effected as the guide roller units 21 are caused to slide relative to the guide rails 11, 12, 13 by the vehicle door opening/closing apparatus 6 to be described later.

Next, with reference to the accompanying drawings, there will be described the vehicle door opening/closing apparatus 6, as the principal portion of the present invention, for sliding the sliding door 2.

Figure 2:
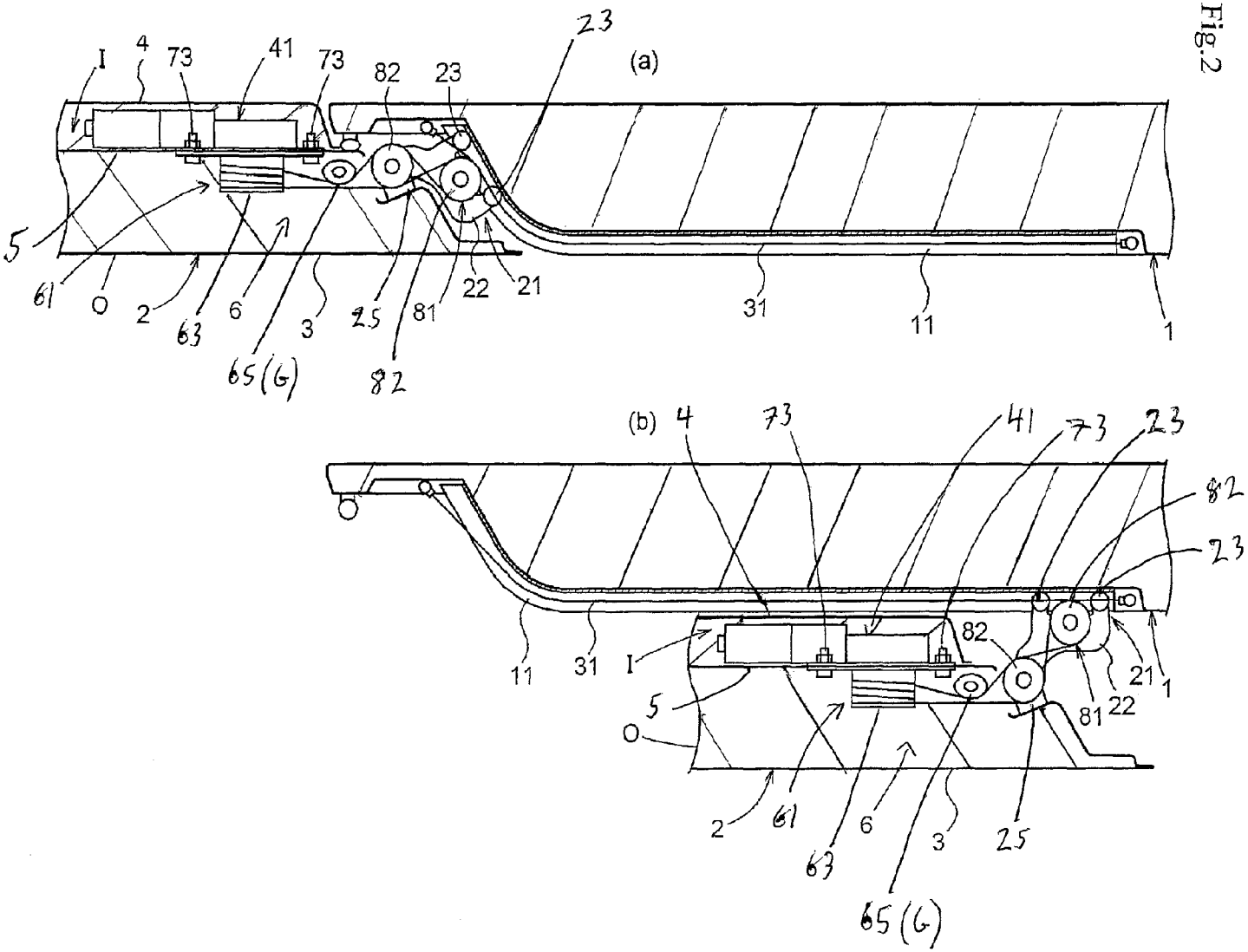
FIG. 2*a* is a section view of a sliding door in the closed position, including the vehicle door opening/closing apparatus relating to the present invention.
FIG. 2*b* is a section view of a sliding door in the opened position, including the vehicle door opening/closing apparatus relating to the present invention.
Figure 3:
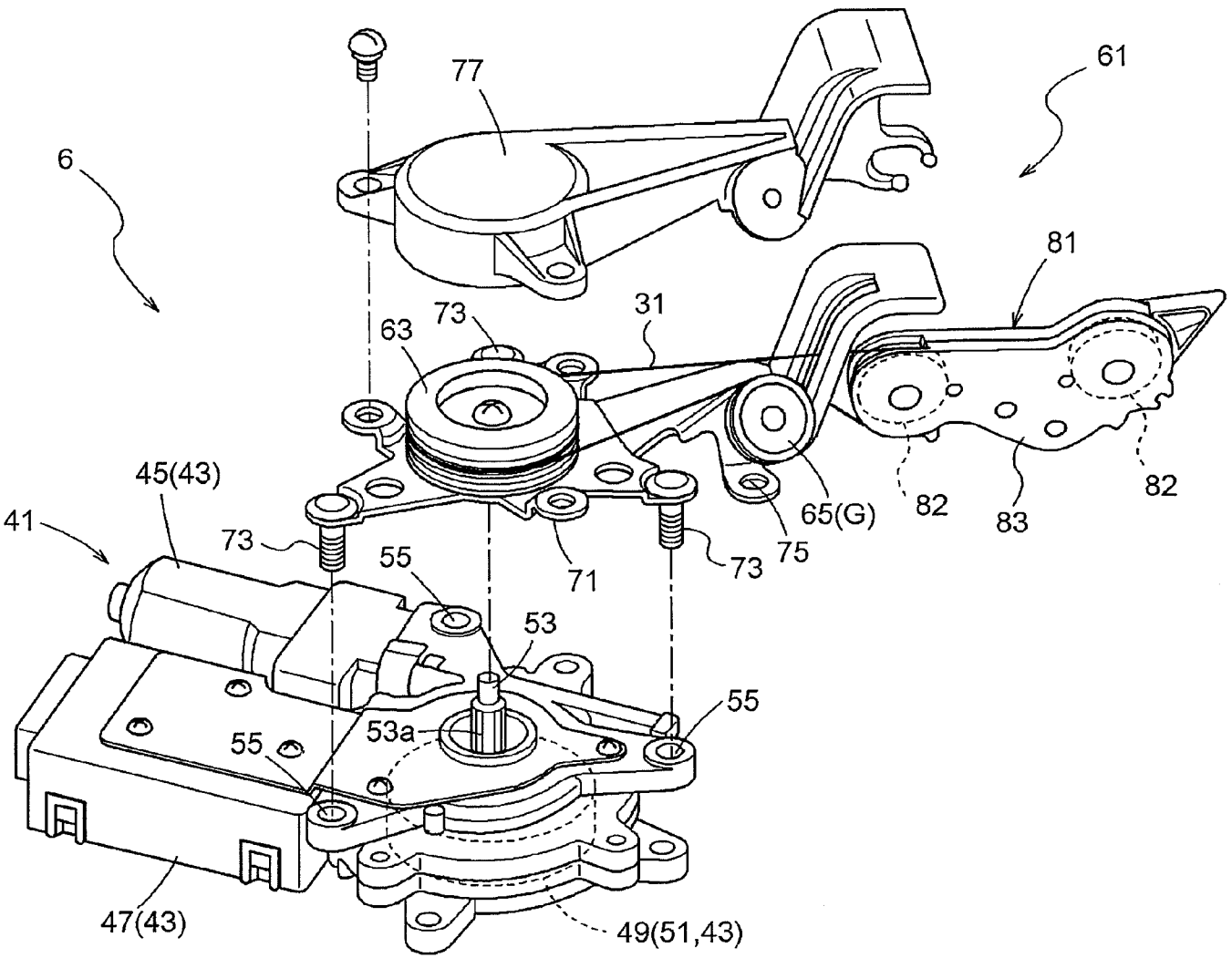
FIG. 3 is an exploded perspective view of the vehicle door opening/closing apparatus relating to the present invention.

As shown in FIG. 2 and FIG. 3, the vehicle door opening/closing apparatus 6 consists mainly of a cable 31, a drive unit 41, and a drum unit 61 having a take-up drum 63. Further, the drive unit 41 and the drum unit 61 are provided as separate units. However, after assembly thereof, these units function as one integral unit.

The cable 31 is disposed between the vehicle 1 body and the take-up drum 63 disposed inside the sliding door 2. In the instant embodiment, the cable 31 comprises a single length of wire and is arranged inside the center guide rail 11, with opposed ends of the cable 31 being retained to predetermined positions of the vehicle body lateral portion adjacent the front end and the rear end of the vehicle 1 in its front/back direction. An intermediate length portion of the cable 31 is wound around the take-up drum 63.

The drive unit 41, as shown in FIG. 3, includes a drive mechanism 43 for driving the take-up drum 63. The drive mechanism 43 includes a motor 45, an ECU (electronic control unit) 47 for electronically controlling the motor 45, a reduction gear mechanism 49 for reducing the speed of rotational output from the motor 45, and a clutch mechanism 51 for engaging/disengaging the transmission of the drive force. The motor 45 is provided as a reversible motor capable of rotating in both the forward and reverse directions. The rotational output from the motor 45 is transmitted via the reduction gear mechanism 49 and the clutch mechanism 51 to a power shaft 53. In the outer peripheral face of this power shaft 53, a serration 53*a* is defined. Though not shown, between the power shaft 53 and the main body of the drive unit 41, a seal member such as an O-ring is provided, so as to prevent intrusion of water along the power shaft 53 into the drive unit 41. Further, the drive unit 41 includes coupling hole portions 55 for allowing insertion therethrough of bolt portions 73 of the drum unit 61 when the drive unit 41 is to be fixed and fastened to the drum unit 61.

The drum unit 61 includes a guide member G and the take-up drum 63. The guide member G is a member for guiding an intermediate length portion of the cable 31 from the side of the center guide rail 11 fixed to the vehicle body toward the take-up drum 63 and in this embodiment, an intermediate pulley 65 is employed as this guide member G. The take-up drum 63 has a cylindrical shape, with an engaging groove 67 (see FIG. 6) being formed in the outer peripheral face of the cylinder. The engaging groove 67 is a groove into which successive length portions of the cable 31 come into engagement, so the cable 31 is wound about the take-up drum 63 along this engaging groove 67. Further, at the center portion of the take-up drum 63, there is defined a concave portion 69 (see FIG. 4) into which the power shaft 53 of the drive unit 41 as the power source is to be inserted. In the inner peripheral face of this concave portion 67, there is formed a serration 69*a*, with which the serration 53*a* of the power shaft 53 comes into engagement. With the power shaft 53 formed with the serration 53*a* and the concave portion 69 formed with the serration 69*a*, the rotational drive force of the drive unit 41 can be transmitted to the take-up drum 63 and also the take-up drum 63 and the drive unit 41 can be engaged with and disengaged from each other. Therefore, the power shaft 53 formed with the serration 53*a* and the concave portion 69 formed with the serration 69*a* together constitute a "power transmission mechanism" in the present invention. Under the engaged condition of these, the drive mechanism 43 rotatably drives the take-up drum 63 via the power shaft 53. As the take-up drum 63 is rotated to take up the cable 31, the sliding door 2 can be moved back and forth, according to its rotational direction.

That is to say, under the closed condition (the condition shown in FIG. 2 (*a*)), when the motor 45 is driven in the forward direction to rotate the take-up drum 63 in one direction, the cable 31 is taken up around the take-up drum 63 and also the cable 31 is paid out from the take-up drum 63. Since the cable 31, at its one end, is retained to the predetermined position (in this case, at a rear portion of the vehicle 1, the right side in FIG. 2 (*a*)), in the lateral portion of the vehicle body, the sliding door 2 to which the drum unit 61 is fixed is moved rearward of the vehicle 1 along the guide rails 11, 12, 13 via the guide roller units 21 which slide on these guide rails 11, 12, 13. As the result, the sliding door 2 is opened. On the other hand, under the opened condition (the condition shown in FIG. 2 (*b*)) of the sliding door 2, when the motor 45 is driven in the reverse direction to rotate the take-up drum 63 in the other direction, in the reverse direction to the above direction, the cable 31 is taken up around the take-up drum 63 and also the cable 31 is paid out from the take-up drum 63. Since the cable 31, at its one end, is retained to the predetermined position (in this case, at a front portion of the vehicle 1, the left side in FIG. 2(*b*)), in the lateral portion of the vehicle body, the sliding door 2 to which the drum unit 61 is fixed is moved forward of the vehicle 1 along the guide rails 11, 12, 13 via the guide roller units 21 which slide on these guide rails 11, 12, 13. As the result, the sliding door 2 is closed.

Referring back to FIG. 3, the drum unit 61 includes a base plate 71 and a cover case 77 fixed to this base plate 71. The take-up drum 63 and the intermediate pulley 65 as the guide member G are rotatably fixed to the base plate 71, respectively. The base plate 71 forms bolt portions 73. These bolt portions 73 are formed at positions corresponding to the coupling hole portions 55 of the drive unit 41. So, as these bolt portions 73 are inserted through the coupling hole portions 55 and then fastened with nuts, the drive unit 41 and the drum unit 61 are coupled and fixed to each other. That is to say, the bolt portions 73 and the nuts corresponding thereto together correspond to the "coupling mechanism" in the present invention. Incidentally, in the instant embodiment, three of the bolt portions 73 are provided at positions which divide the perimeter of the rotational axis of the take-up drum 63 into three equal segments, so that with this three-point support arrangement, the drive unit 41 and the drum unit 61 can be fixed to each other in a reliable manner even when the drive mechanism 43 is driven. The base plate 71 further defines a fixing hole portion 75 in the vicinity of the portion thereof where the intermediate pulley 65 is supported. Via this fixing hole portion 75, with a screw or the like, the inner panel 5 and the drum unit 61 as a whole are fixed in a reliable manner.

In the above, it is preferred that the base plate 71 be formed of a material having high rigidity. In the instant embodiment, the base plate 71 is provided as a metal plate. When the vehicle door opening/closing apparatus 6 is to be assembled to the vehicle 1, the metal base plate 71 to which the take-up drum 63 and the intermediate pulley 65 are fixed will be brought into opposition to the inner panel 5 (see FIG. 2), so that the base plate 71, together with the inner panel 5, will be clamped and held between the drive unit 41 and the drum unit 61. The metal base plate 71 inherently has the rigidity sufficient to withstand tension applied between the take-up drum 63 and the intermediate pulley 65 at the time of driving of the drive mechanism 43. But, as this base plate 71, together with the inner panel 5, is clamped and fixed between the drive unit 41 and the drum unit 61, the rigidity is further enhanced. Therefore, even if significant tension is applied to a length of the cable 31 between the take-up drum 63 and the guide member G when the take-up drum 63 is rotatably driven to take up the cable 31, it is possible to prevent warping of the base plate 71 or even destruction of the drum unit 61 in some occasion.

The vehicle door opening/closing apparatus 6 relating to the instant embodiment further includes a pulley mechanism 81 disposed adjacent the drum unit 61. The pulley mechanism 81 includes a pair of guide pulleys 82 which are rotatably mounted inside a pulley case 83. The pulley case 83 is fixed to the base bracket 22 (see FIG. 5) of the guide roller unit 21. The length of the cable 31 guided via the intermediate pulley 65 of the drum unit 61 to the pulley mechanism 81 is further guided to intercross, thereby form a figure-eight loop on opposed sides of the guide pulleys 82 inside the pulley case 83 and then arranged inside the center guide rail 11. This pulley mechanism 81 functions as a tension mechanism for applying an appropriate tension to the cable 31 when the vehicle door opening/closing apparatus 6 is driven.

Figure 6:
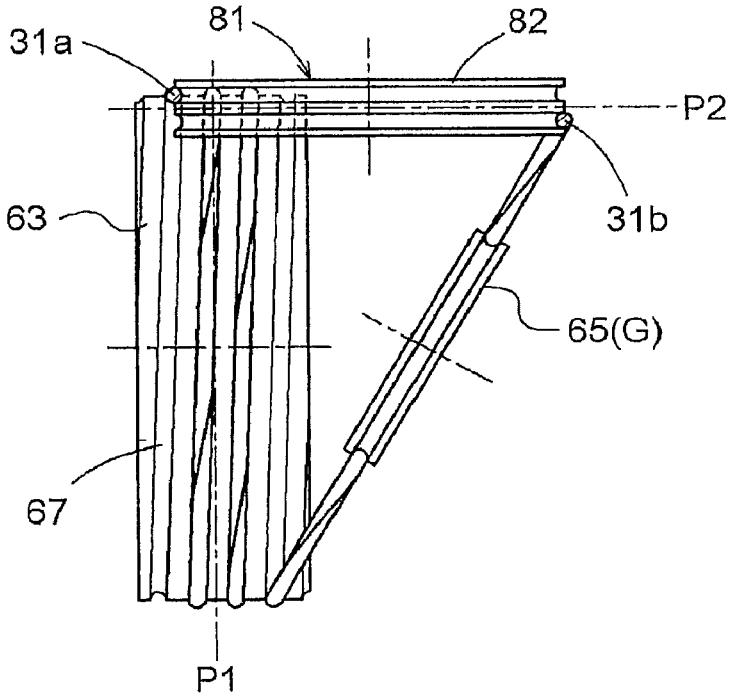
FIG. 6 is an explanatory view explaining the disposing relationship between a drum unit and a pulley mechanism.

Now, FIG. 6 is an explanatory view for explaining disposing relationship between the drum unit 61 and the pulley mechanism 81. As shown in this figure, a plane P1 perpendicular to the rotational center axis of the take-up drum 63 and a plane P2 perpendicular to the rotational center axis of the guide pulley 82 inside the pulley case 83 have an exactly 90 degrees twisted relationship with each other. In this embodiment, of a length of the cable 31*a* extending from the pulley mechanism 81 to the take-up drum 63 and a length of the cable 31*b* extending again from the take-up drum 63 after being wound around this take-up drum 63, for the one length of the cable 31*a*, its direction extending from the pulley mechanism 81 and its direction converging toward the take-up drum 63 are set in agreement with each other. Therefore, for the other length of the cable 31*b*, its direction extending from the pulley mechanism 81 and its direction converging toward the take-up drum 63 are significantly twisted from each other. Hence, the intermediate pulley 65 in this embodiment, is mounted to the base plate 71 of the drum unit 61 such that the intermediate pulley 65 may have an approximately 45 degrees twisted relationship relative to the rotational center axis of the take-up drum 63 and relative to the rotational center axis of the guide pulley 82, respectively. With this arrangement, it becomes possible for the cable 31 to change its direction in a smooth manner at the portion where the above-described two planes P1, P2 intersect each other.

The drive unit 41 and the drum unit 61, as shown in FIG. 2, are disposed inside the sliding door 2 of the vehicle 1. Hence, the sliding door 2 of the vehicle 1 is comprised of an outer door O formed of the outer panel 3 and the inner panel 5 formed of press components and, an inner door I formed of the inner panel 5 and an interior member 4. The drive unit 41 and the drum unit 61 are disposed respectively on the opposed sides of the inner panel 5 constituting the sliding door 2. More particularly, the drum unit 61 is disposed on the inner panel 5 between the outer panel 3 and the inner panel 5 constituting the sliding door 2 of the vehicle 1 (outer door O), whereas the drive unit 41 is disposed between the interior member 4 and the inner panel 5 constituting the sliding door 2 of the vehicle 1 (inner door I), to be coupled and fixed to the drum unit 61 via the inner panel 5.

Next, there will be explained the assembly of the vehicle door opening/closing apparatus 6 having the respective constituent units described above to the vehicle 1.

Figure 4:
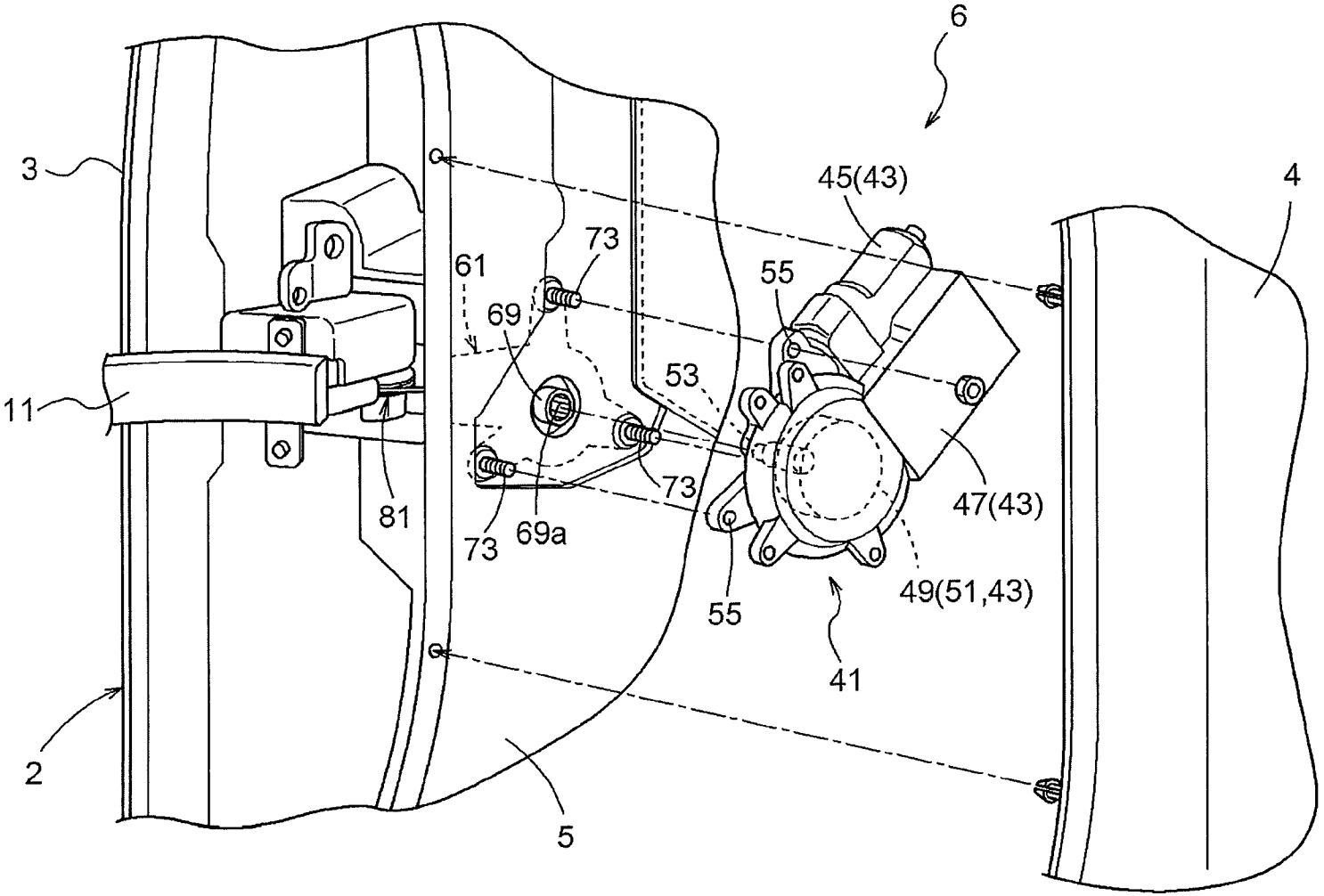
FIG. 4 is an explanatory view for explaining the assembly process of the vehicle door opening/closing apparatus relating to the present invention to the vehicle.

FIG. 4 is an explanatory view for explaining the assembly procedure to the vehicle 1. This figure shows the inner panel 5 as seen from the inside of the inner door I. The openings are provided at positions of the inner panel 5 that correspond to the bolt portions 73 of the drum unit 61, At the first stage of the assembly, through these openings, the bolt portions 73 of the drum unit 61 will be inserted and then temporarily fixed by means of unillustrated nuts, clips or the like, whereby first, the drum unit 61 will be mounted to the inner panel 5 inside the outer door O. In this way, by mounting the drum unit 61 to the inner panel 5 from the inside of the outer door O, the cable can be laid in the center guide rail 11 without causing this cable 31 to extend through the inner panel 5, whereby the cable laying operation is facilitated.

Next, at the second stage of the assembly, the serration 53*a* formed in the power shaft 53 of the drive unit 41 will be brought into engagement with the serration 69*a* formed in the concave portion 69 of the take-up drum 63 of the drum unit 61. Then, the unillustrated nuts, clips or the like which have been used for temporary fixing of the drum unit 61 will be removed and the bolt portions 73 projecting from the opening portions of the inner panel 5 will be inserted through the coupling hole portions 55 of the drive unit 41 and fixed with nuts; and the drum unit 61, the inner panel 5 and the drive unit 41 will be fastened together. In this way, the drive unit 41 and the drum unit 61 are mounted respectively on the opposed faces of the inner panel 5 constituting the sliding door 2 and the drive unit 41 and the drum unit 61 are coupled to each other, with the inner panel 5 being clamped there between. In this, as the inside of the inner door I where the drive unit 41 is disposed is a water-proof area preventing intrusion of water through the inner panel 5 from the outside of the vehicle, there is no need to provide any special water-proof treatment to the drive unit 41. Therefore, the drive mechanism 43 can be disposed under the water-proof environment in a reliable manner and at low costs.

In this way, by forming the serrations 53*a*, 69*a* in the power shaft 53 for outputting the rotational drive force of the drive unit 41 and in the concave portion 69 provided at the center of the take-up drum 63, respectively, the power transmission mechanism for transmitting the rotational drive force of the drive unit 41 to the take-up drum 63 can be rendered freely engageable with and disengageable from each other; therefore, the drum unit 61 and the drive unit 41 can be provided as separate units. Hence, it becomes possible to assemble these units separately one after another as described hereinbefore and the weights to be held can be divided, so that the workload for the worker at the time of the assembly of the vehicle door opening/closing apparatus 6 to the vehicle 1 can be alleviated.

[Further Embodiment 1]

In the foregoing embodiment, the drive unit 41 and the drum unit 61 were coupled with each other by coupling mechanism, with the inner panel 5 being clamped therebetween. An alternative arrangement to this is possible as follows.

Figure 7:
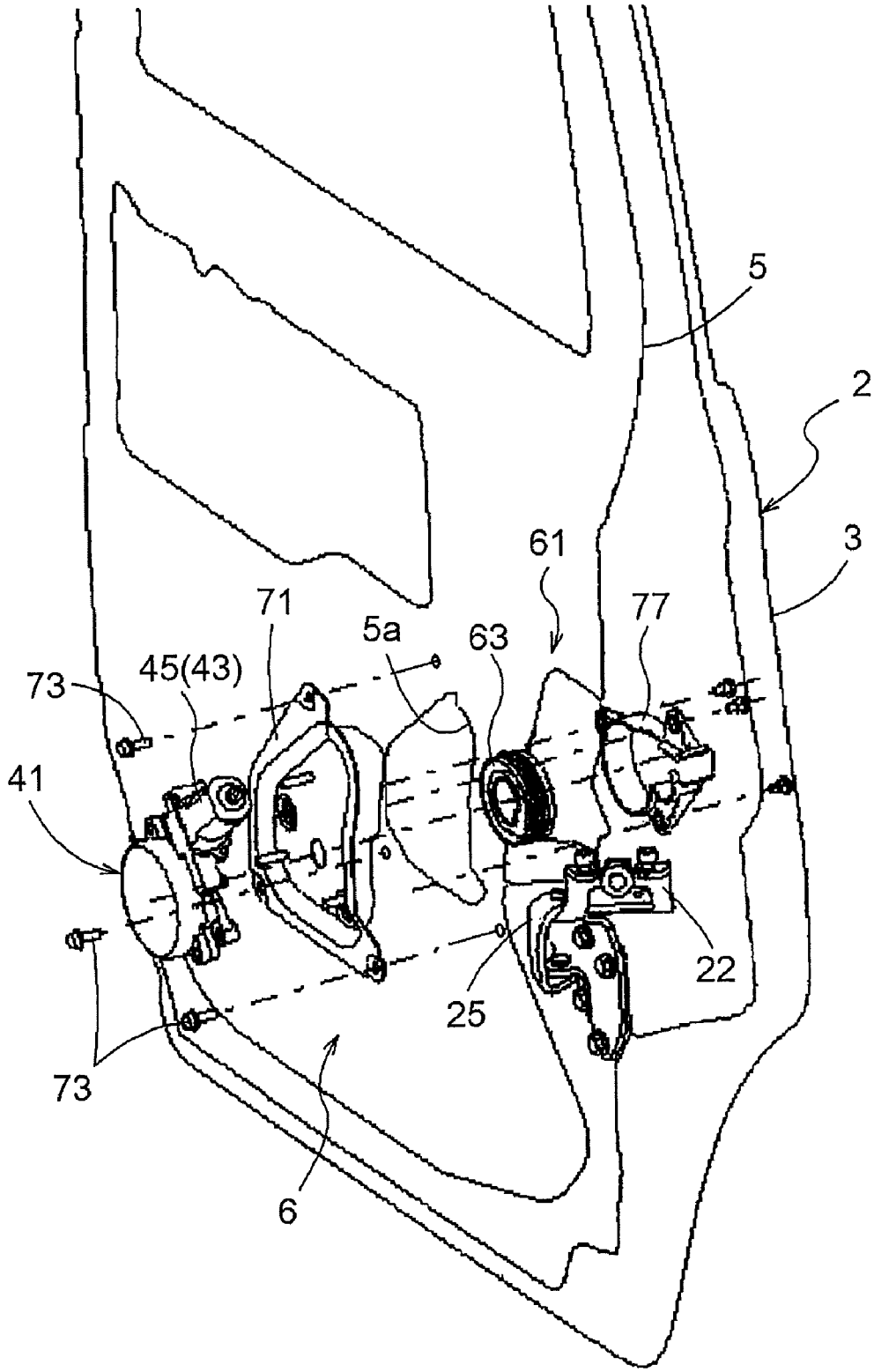
FIG. 7 is an exploded perspective view showing a mode of attachment of a drive unit and a drum unit according to a further embodiment.
Figure 8:
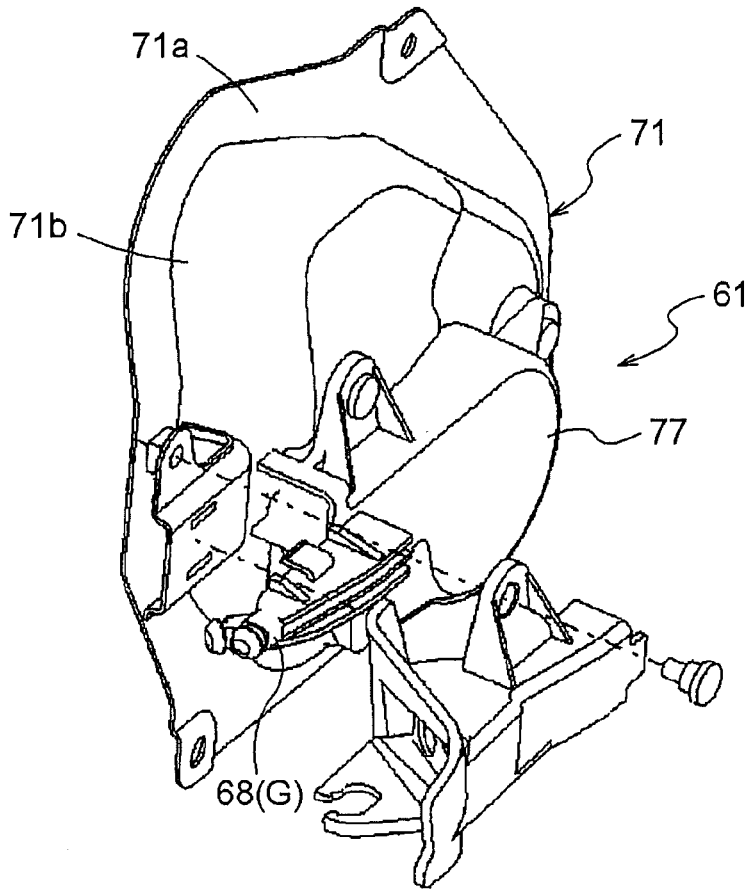
FIG. 8 is a perspective view showing a base plate in a further embodiment.

Namely, the inner panel 5 defines a through hole 5*a* extending through one face and the other face of the panel, and, the base plate 71 can be fitted in this through hole 5*a*. And, to one face of this base plate 71, the drum unit 61 is mounted and to the other face of the same, the drive unit 41 is disposed and under this condition, the base plate is disposed within the through hole 5*a* (FIGS. 7 and 8).

The base plate 71 constituting one member of the inner panel 5 includes a flange portion 71*a* to be brought into opposition to and coupled to the inner panel 5 and a concave portion 71*b* for accommodating therein the drive unit 41 for instance. The drum unit 61 is mounted to the opposite side across the concave portion 71*b*. The base plate 71 is coupled and fixed to the inner panel 5 by the bolt portions 73 and the nuts corresponding thereto, which together act as the coupling mechanism.

With this construction, the drive unit 41 and the drum unit 61 will be coupled and filed to the base plate 71, thereby to form an integral unit in advance. Then, by assembling this integral unit to the inner panel 5 so as to close the through hole 5*a*, the drive unit 41 and the drum unit 61 can be easily mounted to the inner panel 5.

As the base plate 71 and the inner panel 5 are integrated with each other, with the flange portion 71*a* being overlapped with the inner panel 5. Therefore, the rigidity of the inner panel 5 is enhanced. As a result, even if a large tension is applied to the length of the cable 31 between the take-up drum 63 and the guide member G e.g. when the take-up drum 63 is rotatably driven to take up the cable 31, it is possible to avoid warping of the base plate 71 or destruction of the drum unit 61 per se.

The attaching faces of the drive unit 41 and the drum unit 61 to the base plate 71 may be flush with the surface of the inner panel 5 in the cross sectional view thereof. However, in accordance with the dept of the concave portion 71*b* defined in the base plate 71, the attaching faces for the drive unit 41 and the drum unit 61 may be different from each other, relative to the plane of the inner panel 5 surface as a reference. For instance, in case the drive unit 41 and the drum unit 61 are to be mounted to different types of vehicles, this can be coped with by changing only the shape of the base plate 71. By providing base plates 71 with differing depths of the concave portion 71*b*, it becomes possible to use common drive unit 41 and drum unit 61 for different types of vehicle, thus achieving cost reduction and also to avoid interference with other members such as a window to be mounted inside the sliding door 2.

With this construction too, like that of the foregoing embodiment, the drum unit 61 will be disposed in the space between the outer panel 3 and the inner panel 5, whereas the drive unit 41 will be disposed in the space between the interior member 4 and the inner panel 5.

Furthermore, the drum unit 61 is provided with the guide member G for changing the direction of the length of the cable 31 extended from the take-up drum 63, and the take-up drum 63 and the guide member G are fixed to the base plate 71 (FIG. 8).

{Further Embodiment 2}

Figure 9:
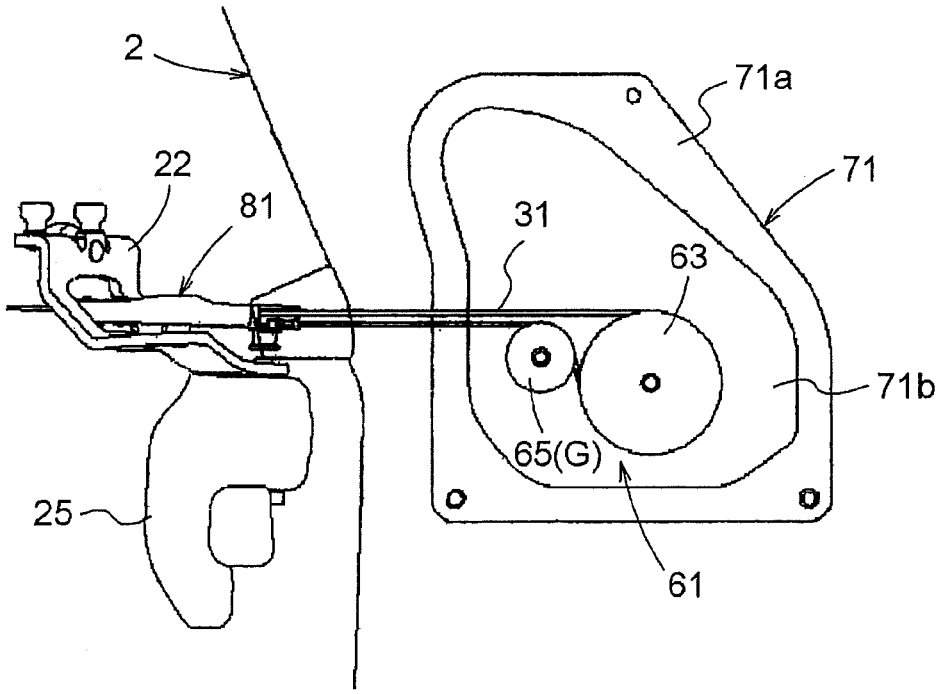
FIG. 9 is a view showing a guide member mounted to the base plate in the further embodiment.

In the foregoing embodiment, the guide member G may be disposed adjacent the take-up drum 63 and configured to be adjustable in its attaching position relative to the base plate 71 (FIGS. 9, 10).

For instance, when the guide member G (intermediate pulley 65) is to be assembled to the base plate 71, the intermediate pulley 65 will be coupled in advance to an attaching member having an elongate hole, and then, this attaching member will be fixed so that the intermediate pulley 65 may be located at the optimum position. With this construction of the guide member G, there is provided a greater freedom in the cable layout, such as the possibility of setting the inter-path pitch of the cable 31 as desired.

Figure 12:
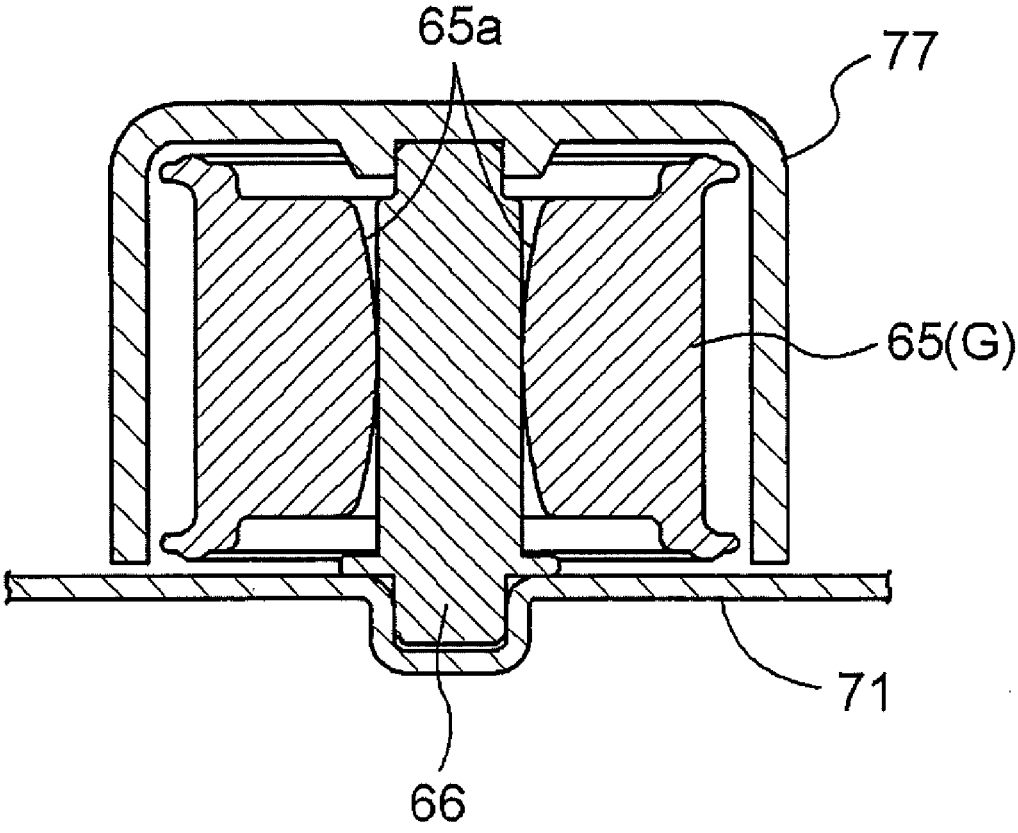
FIG. 12 is a section view of a pulley in a further embodiment.

Incidentally, in the intermediate pulley 65 described above, its sliding contact face relative to the pin 66 as a support member for rotatably attaching this intermediate pulley 65 to the base plate 71 may have a shape curved along the axial direction of the pin 66 (R-like shape) (FIGS. 11, 12). This pin 66 has its upper end and its lower end supported respectively by the cover case 77 and the base plate 71.

With the above arrangement, even when the attaching has been effected with the pin 66 being inclined for instance, as the sliding contact face 65*a* has the R-like shape, the posture of the intermediate pulley 65 can be maintained appropriate.

Further, if the intermediate pulley 65 is provided adjacent the take-up drum 63, the space required for laying out the cable 31 can be reduced advantageously.

[Other Embodiments]

(1) The foregoing embodiment employed, as the power transmission mechanism, the power shaft 53 having the serration 53*a* and the concave portion 69 having the serration 69*a*. Instead, any other mechanism can be employed as long as such other mechanism too allows transmission of the rotational drive force of the drive unit 41 to the take-up drum 63 and also allows engagement and disengagement between the take-up drum 63 and the drive unit 41. For instance, the mechanism can comprise splines formed respectively in the power shaft 53 and the concave portion 69.

(2) The foregoing embodiment employed a metal plate as the base plate 71. However, instead of the metal plate, e.g. a resin plate may be employed. In the case of using a resin plate, it is preferred to employ one having high rigidity. Specifically, it is preferred to use a plate made of polyamide, FRB (fiber reinforced plastic), etc.

(3) In the foregoing embodiment, there was explained the example of three-point support wherein three bolt portions 73 are provided at positions diving the perimeter of the take-up drum 63 into three equal segments. However, the number of bolt portions 73 is not limited to three, but the support can be provided at four or more points. Further, as long as the drive unit 41 and the drum unit 61 can be fixed in a reliable manner when the drive mechanism 43 is driven, the number of the bolt portions 73 may be two, thus providing a two-point support.

(4) In the foregoing embodiment, there was explained the example wherein the intermediate pulley 65 was employed as the guide member G for guiding the cable 31 from the side of the center guide rail 11 fixed to the vehicle 1 to the take-up drum 63. However, instead of the intermediate pulley 65, it is possible to employ a guide shoe (guide groove) 68 or the like configured to change the direction of the cable 31 while allowing sliding of the cable 31 thereon. And, such guide shoe can be provided in the drum unit 61, for instance (FIG. 8).

(5) In the foregoing embodiment, the cable 31 comprised a single wire and the opposed ends thereof were retained at predetermined portions adjacent the front end and the rear end of the center guide rail 11 in the front/back direction of the vehicle 1 Instead, the cable 31 may be connected in the form of a ring to be retained to the vehicle 1 at one or more positions.

(6) Further, the cable 31 may comprise two wires, with one end of each wire being retained to the take-up drum 63, the other end thereof being retained at a predetermined portion adjacent the front end or the rear end of the center guide rail 11 in the front/back direction of the vehicle 1.

Industrial Applicability

The present invention may be suitable used for a vehicle door opening/closing apparatus for opening/closing a door provided at a lateral portion of a vehicle.

The invention claimed is:

1. A vehicle door opening/closing apparatus comprising:

a drum unit disposed on one side of an inner panel constituting a vehicle sliding door and including a take-up drum configured to take up a length of cable disposed between the vehicle and the vehicle sliding door;

a drive unit disposed on an opposite side of the inner panel and configured to drive the take-up drum;

a power transmission mechanism configured for transmitting a rotational drive force of the drive unit to the take-up drum, with allowing engagement and disengagement between take-up drum and the drive unit; and a coupling mechanism for coupling the drive unit to the drum unit, with the inner panel clamped there between.

2. The vehicle door opening/closing apparatus according to claim 1, wherein the drum unit is disposed between an outer panel constituting the vehicle sliding door and the inner panel and the drive unit is disposed between an interior member constituting the vehicle sliding door and the inner panel.

3. The vehicle door opening/closing apparatus according to claim 1, wherein the drum unit includes a guide member configured to change the direction of the cable extended from the take-up drum, and the take-up drum and the guide member are fixed to a base plate disposed in opposition to the inner panel.

4. The vehicle door opening/closing apparatus according to claim 3, wherein the guide member attaching position at which the guide member is attached is changeable.

5. The vehicle door opening/closing apparatus according to claim 3, wherein the guide member comprises a pulley attached to the base plate.

6. The vehicle door opening/closing apparatus according to claim 5, wherein the pulley includes a sliding contact face for a support member for rotatably supporting the pulley to the base plate, and the sliding contact face has a shape curved along an axial direction of the support member.

7. The vehicle door opening/closing apparatus according to claim 3, wherein the guide member comprises a guide groove provided in the drum unit.

8. The vehicle door opening/closing apparatus according to claim 1, wherein:

the inner panel includes a through hole extending through the inner panel; and a base plate, the drum unit being disposed on one side of the base plate and the drive unit being disposed on an opposite side of the base plate;

wherein the drive unit is aligned with the through hole.

9. The vehicle door opening/closing apparatus according to claim 8, wherein the drum unit is disposed between an outer panel constituting the vehicle sliding door and the inner panel, and the drive unit is disposed between an interior member constituting the vehicle sliding door and the inner panel.

10. The vehicle door opening/closing apparatus according to claim 8, wherein the drum unit includes a guide member configured to change a direction of the cable extended from the take-up drum, and the take-up drum and the guide member are fixed to the base plate.

11. The vehicle door opening/closing apparatus according to claim 1, wherein the inner panel includes a through hole extending through the inner panel and a base plate, the drum unit being disposed on one side of the base plate and the drive unit being disposed on an opposite side of the base plate, the drive unit including a motor possessing an output shaft whose axis passes though the through hole.

12. A vehicle door opening/closing apparatus comprising:

a drum unit disposed on one side of an inner panel constituting a vehicle sliding door and including a take-up drum configured to take up a length of cable disposed between the vehicle and the vehicle sliding door;

a drive unit disposed on an opposite side of the inner panel and configured to drive the take-up drum;

a power transmission mechanism configured for transmitting a rotational drive force of the drive unit to the take-up drum and allowing engagement and disengagement between the take-up drum and the drive unit;

a base plate configured to be attached to the inner panel;

wherein the drum unit is fixed to one side of the base plate, and the drive unit is fixed to an opposite side of the base plate;

wherein the drum unit further includes:

a guide member configured to change a direction of the cable extended from the take-up drum; and a cover member configured to cover the guide member, the take-up drum, and the cable disposed between the guide member and the take-up drum.

13. The vehicle door opening/closing apparatus according to claim 12, wherein the drum unit is disposed between an outer panel constituting the vehicle sliding door and the inner panel, and the drive unit is disposed between an interior member constituting the vehicle sliding door and the inner panel.

14. The vehicle door opening/closing apparatus according to claim 12, wherein a guide member attaching position at which the guide member is attached is changeable.

15. The vehicle door opening/closing apparatus according to claim 12, wherein the guide member comprises an intermediate pulley attached to the base plate.

16. The vehicle door opening/closing apparatus according to claim 15, wherein the intermediate pulley includes a sliding contact face for a support member for rotatably supporting the intermediate pulley to the base plate, and wherein the sliding contact face has a shape curved along an axial direction of the support member.

17. The vehicle door opening/closing apparatus according to claim 15, further comprising a pulley mechanism which is disposed adjacent to the drum unit and has a guide pulley for guiding the cable to a guide rail provided in the vehicle, wherein a rotational axis of the drum unit, a rotational axis of the guide pulley, and a rotational axis of the intermediate pulley are in twisted relationship to one another, and a rotational plane of the intermediate pulley, a rotational plane of the drum unit and a rotational plane of the guide pulley intersect one another.

18. The vehicle door opening/closing apparatus according to claim 15, further comprising a pulley mechanism which is disposed adjacent to the drum unit and has a guide pulley for guiding the cable to a guide rail provided in the vehicle, wherein when the vehicle sliding door is in a closed state, the guide pulley and the take-up drum are positioned in an extending direction of the guide rail provided in the vehicle.

19. The vehicle door opening/closing apparatus according to claim 12, wherein the base plate has a recess for accommodating the drive unit.

20. A vehicle sliding door opening/closing apparatus for slidably opening and closing a vehicle sliding door that is slidably mounted on a vehicle comprising:

a drum unit fixed to an inner panel and positioned on one side of the inner panel, the drum unit including a take-up drum;

a drive unit fixed to the inner panel and positioned on an opposite side of the inner panel, the drive unit being operatively connected to the take-up drum to rotatably drive the take-up drum;

a power transmission mechanism configured to transmit rotational drive force from the drive unit to the take-up drum to rotate the take-up drum, the power transmission mechanism permitting engagement and disengagement between the take-up drum and the drive unit;

the inner panel constituting a part of the vehicle sliding door that slidably moves together with the vehicle sliding door;

a cable at least partially wound around the take-up drum, the cable being disposed between the vehicle and the vehicle sliding door; and a coupling mechanism for coupling the drive unit to the drum unit.

* * * * *